US006554745B2

(12) United States Patent
Pham

(10) Patent No.: US 6,554,745 B2
(45) Date of Patent: Apr. 29, 2003

(54) EXERCISE APPARATUS USING MAGNETISM TO AUGMENT GRAVATATIONAL FIELD

(76) Inventor: Luc H. Pham, 617 Kingman Dr., Charlotte, NC (US) 28217

( * ) Notice: Subject to any disclaimer, the term of this patent is extended or adjusted under 35 U.S.C. 154(b) by 58 days.

(21) Appl. No.: 09/928,338

(22) Filed: Aug. 14, 2001

(65) Prior Publication Data

US 2002/0022550 A1 Feb. 21, 2002

Related U.S. Application Data

(60) Provisional application No. 60/224,896, filed on Aug. 14, 2000.

(51) Int. Cl.[7] ..... A63B 21/00

(52) U.S. Cl. ..... 482/1; 482/6; 482/124; 2/69

(58) Field of Search ..... 482/1, 3–9, 12, 482/83, 84, 88, 124, 148, 900–902, 903; 2/1, 455, 456, 2.11–2.13, 69, 69.5

(56) References Cited

U.S. PATENT DOCUMENTS 4,585,282 A 4/1986 Bosley
4,599,751 A 7/1986 Bouwhuis
4,761,579 A 8/1988 Delassus
4,910,633 A 3/1990 Quinn
5,113,339 A 5/1992 Whalen et al.
5,659,895 A * 8/1997 Ford ..... 2/2.11
5,937,442 A * 8/1999 Yamaguchi et al. ..... 2/69
6,050,822 A 4/2000 Faughn
6,176,816 B1 * 1/2001 Dicker et al. ..... 482/124

* cited by examiner

*Primary Examiner*—Glenn E. Richman
(74) *Attorney, Agent, or Firm*—Richard C. Litman

(57) ABSTRACT

The exercise apparatus using magnetism to augment the gravitational field of the earth has a platform made of ferromagnetic material which is magnetized by an electromagnet. The exerciser wears a full-body chain mail suit and stands on the platform while performing exercise activity so that the magnetic field created by the electromagnet pulls on the chain mail suit, The electromagnet is connected to a variable current power source, and the circuitry may include either a trimmer potentiometer for continuously varying the strength of the magnetic field, or a computer with software for entering and controlling the strength of the magnetic field as a multiple of the strength of the gravitational field. The apparatus is installed in a permanent structure, or movably mounted for portable use in the home. Spacecraft utilization is also anticipated in shielded room.

20 Claims, 8 Drawing Sheets

EXERCISE APPARATUS USING MAGNETISM TO AUGMENT GRAVATATIONAL FIELD

CROSS-REFERENCE TO RELATED APPLICATION

This application claims the benefit of U.S. Provisional Patent Application Ser. No. 60/224,896, filed Aug. 14, 2000.

BACKGROUND OF THE INVENTION

1. Field of the Invention

The present invention relates to an exercise apparatus using magnetism to augment the effects of the earth's gravitational field, and particularly to the combination of a ferromagnetic exercise suit with an electromagnetic exercise platform.

2. Description of Related Art

The number and variety of exercise apparatus currently available reflect modern society's perceived need for devices which assist the user in obtaining sufficient exercise to promote general health, as well as the development of the strength, speed, endurance, and agility required to perform specialized occupations that no single device has been found satisfactory for the achievement of the diverse goals for which a program of exercise is undertaken. The present invention is directed to an exercise apparatus which is designed to be useful to world class athletes, martial artists, bodybuilders, and the like, as well as in training programs for prospective astronauts, the military, and other occupations. At the same time the exercise apparatus of the present invention provides beneficial exercise which would be appropriate for the ordinary individual who frequents the gym for casual exercise.

The present invention is directed to an exercise apparatus which includes an electromagnet positioned below an exercise platform. The exerciser wears a ferromagnetic body suit which is subjected to the pull of the magnetic field developed by the electromagnet during exercise. The strength of the magnetic field is governed by the current through the electromagnet coil and is users regulated under computer control to set the strength of the magnetic field at any desired ratio greater than one with respect to the strength of the gravitational field. The human body develops in the earth's gravitational field, and consequently muscle strength and agility are conditioned by the strength of the earth's gravitational field. The theory of the device is that exercise in a field having greater strength than the earth's gravitational field due to the additional pull of the magnetic field developed by the apparatus will result in greater muscular strength, leaping ability, etc., similar to the effect experienced by astronauts in the lower gravitational field of the moon. It is also thought that the remote effects of magnetic flux on the body result in acceleration of the circulation of the blood and transfer of bio-energy to all areas of the body, relieving discomfort and stiffness and facilitating the maintenance of peripheral blood flow.

U.S. Pat. No. 5,133,339, issued Jul. 28, 1992 to Whalen et al., discloses a device which is used for providing exercise during travel in space flight, or for high performance athletic training and other applications on earth. The device uses air pressure to apply a high force to the body and may be used to simulate the effects of the earth's gravitational field while traveling in space, or to augment the gravitational force on earth by a negative pressure chamber.

U.S. Pat. No. 6,050,822, issued Apr. 18, 2000 to J. A. Faughn, describes a device which features a plate having a surface with a low coefficient of friction and a plurality of cavities housing electromagnets and sensors which are connected to a computer. The user wears boots having metal plates or other ferromagnetic material built in. A calibration strip is used so that the computer can form a record of the user's normal walking gait, running gait, etc., from the sensor input. The device can then be used to direct a person's steps to keep him in one place as he walks, runs, etc. A helmet provides 3D visualization of a virtual environment. The device is not used to enhance the gravitational field, but appears only to be used to direct lateral movement of the user's feet.

A variety of devices are known, which use a magnetic field to levitate objects, either by an electromagnet below the object which repels a natural magnet of opposite polarity, or by an electromagnet positioned above the object to attract a ferromagnetic material in the object. Representative devices of this type are shown in U.S. Pat. No. 4,585,282, issued Apr. 29, 1986 to R. W. Bosley, U.S. Pat. No. 4,761,579, issued Aug. 2, 1988 to J. Delassus, U.S. Pat. No. 4,910,633, issued Mar. 20, 1990 to L. P. Quinn, and International patent application WO 94/10746, published May 11, 1994. Such devices teach away from the present invention, as they oppose the earth's gravitational field rather than enhancing the earth's gravitational field.

U.S. Pat. No. 4,599,751, issued Jul. 15, 1986 to H. E. Bouwhuis, shows a pair of underpants made of chain metal and having a belt and lock to deter sexual assault. U.S. Pat. No. 5,659,895, issued Aug. 26, 1997 to T. J. Ford, Jr., shows a full-body suit made from an elastic or resilient material which is preferably fitted to the body when it is in a fetal position, therefore requiring effort which strains the bone structure and prevents the flow of fluids to the torso during movement.

None of the above inventions and patents, taken either singly or in combination, is seen to describe the instant invention as claimed.

SUMMARY OF THE INVENTION

The exercise apparatus using magnetism to augment the gravitational field of the earth has a platform made of ferromagnetic material which is magnetized by an electromagnet. The top surface of the platform may be covered by a thin sheet of rubber padding for electrical insulation. The exerciser wears a full-body ferromagnetic suit and stands on the platform while performing exercise activity so that the magnetic field created by the electromagnet pulls on the ferromagnetic suit, augmenting gravitational pull on the exerciser's body and the chain mail suit. The electromagnet is connected to a variable current power source, and the circuitry may include either a solid state power controller for continuously varying the strength of the magnetic field, or a computer with software for entering and controlling the strength of the magnetic field as a multiple of the strength of the gravitational field. The apparatus may be attached to a building or permanent structure, such as a gym, or mounted on a wheeled cart for portable use and storage in the home. The apparatus may be combined with a treadmill. The apparatus may also be used in an exercise room or cubicle for zero gravity.

Accordingly, it is a principal object of the invention to provide an exercise apparatus which uses a magnetic field to augment gravitational pull on the body of the exerciser.

It is another object of the invention to provide an exercise apparatus in which the downward force exerted on the exerciser's body may be adjusted by the exerciser as a multiple of the normal gravitational pull on the exerciser's body.

It is a further object of the invention to provide an exercise apparatus using magnetism augment the earth's gravitational field which may be installed in a building or other permanent structure.

Still, another object of the invention is to provide an exercise apparatus using magnetism to augment the earth's gravitational field in a portable unit for use and storage in the home.

Yet another object of the invention is to provide an exercise apparatus which may be used by space travelers in a shielded exercise cubical which, less than zero gravity conditions, accommodates a group of exercisers at once.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
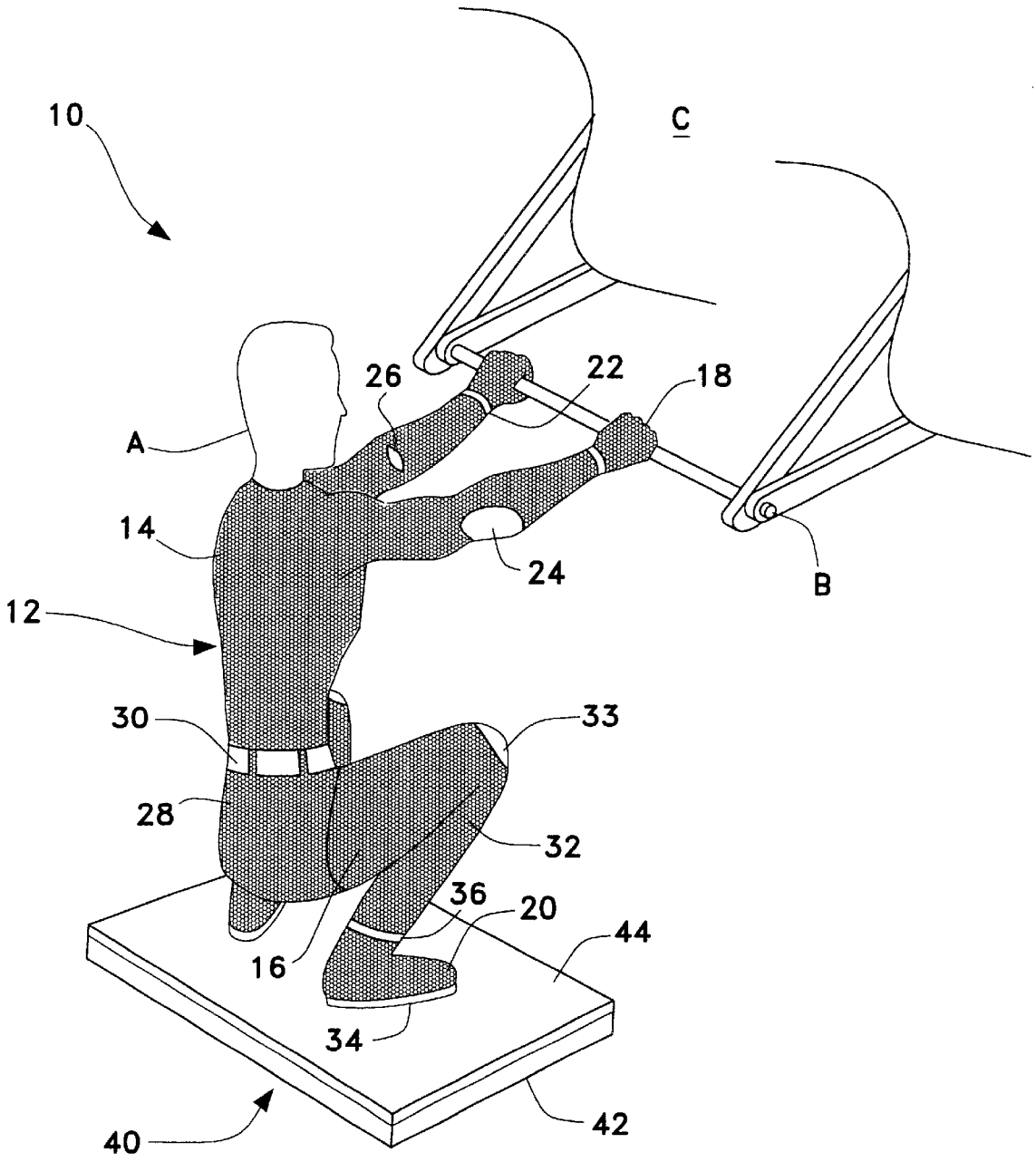
FIG. 1 is an environmental, perspective view of an exercise apparatus using magnetism to augment the earth's gravitational field according to the present invention.

The present invention is an exercise apparatus using magnetism to augment the gravitational field, and is referenced generally as 10 in the drawings. FIG. 1 shows an exerciser A using the apparatus 10 to perform knee bends with the assistance of a parallel bar B attached to the wall C of a gymnasium or other structure. The apparatus 10 consists of an exercise suit 12, which may be made either from chain mail or from a cotton material adorned with magnets used in combination with a platform 40 below which is disposed an electromagnet.

In a first embodiment, the exercise suit 12 is a full body suit which may be composed of a number of sections which are releasably joined to each other, and covers the body of the exerciser A with chain mail or other ferromagnetic material from the base of the neck to the upper or dorsal surface of the foot. For example, the suit may include a vest portion 14, a pant portion 16, a pair of gloves 18, and a pair of feet 20. The vest portion 14 covers the upper torso from the base of the neck to the waist or hips, and includes shoulder and arm portions which extend to about the wrist or to the middle of the forearm. The gloves 18 cover the hands and wrists of the exerciser A and are releasably attached to the arms of the vest 14 by fasteners 22, which may be zippers, hook and loop material (Velcro®), or other releasable fastening material. The vest 14 may include elbow pads 24 for absorbing impact on the posterior side of the elbow and holes 26 on the anterior side to allow the chain mail to flex when bending the joint. Additional holes may be located at other joints of the body, such as the armpits, the back of the knees, etc. The vest 14 may include a zipper, hook and loop, or other releasable fastener along the anterior midline of the suit 12 for ease in taking the vest 14 on and off. The vest 14 as designed for women may include an open area (not shown) in the pectoral region, as the female breast region may be tender and it therefore is not desirable to exert a pulling force on this area.

The pants 16 include an integral brief 28 made from cotton, the rear and sides of the brief being covered with chain mail while the crotch area is not in order to avoid a pulling force being applied to the genitals. The waist of the brief includes a releasable fastener, preferably a zipper, for attaching the vest portion 14 to the pants 16, and a belt 30 for retaining the pants above the hips. The pants 16 include legs 32 and extend from the waist to about the calf region of the lower leg. The legs 32 may include knee pads 33 to protect the kneecaps and may have holes (not shown) in the back of the knees to allow for flexing of the knees, similar to the holes 26 defined in the anterior aspect of the elbow. The elbow pads 24 and knee pads 33 are made from a resilient material for flexing and bending. The foot portions 20 include a chain mail portion extending from the calves to the dorsal or upper surface of the feet. The feet portions include a sole 34 made from rubber, canvas, or other material similar to the soles of athletic shoes. Each foot portion 20 is connected to the legs 32 by a releasable fastener (zipper, hook and loop fastening material, etc.) 36 and may also include a zipper (not shown) on its anterior midline for ease in putting the foot portion 20 on.

Figure 2:
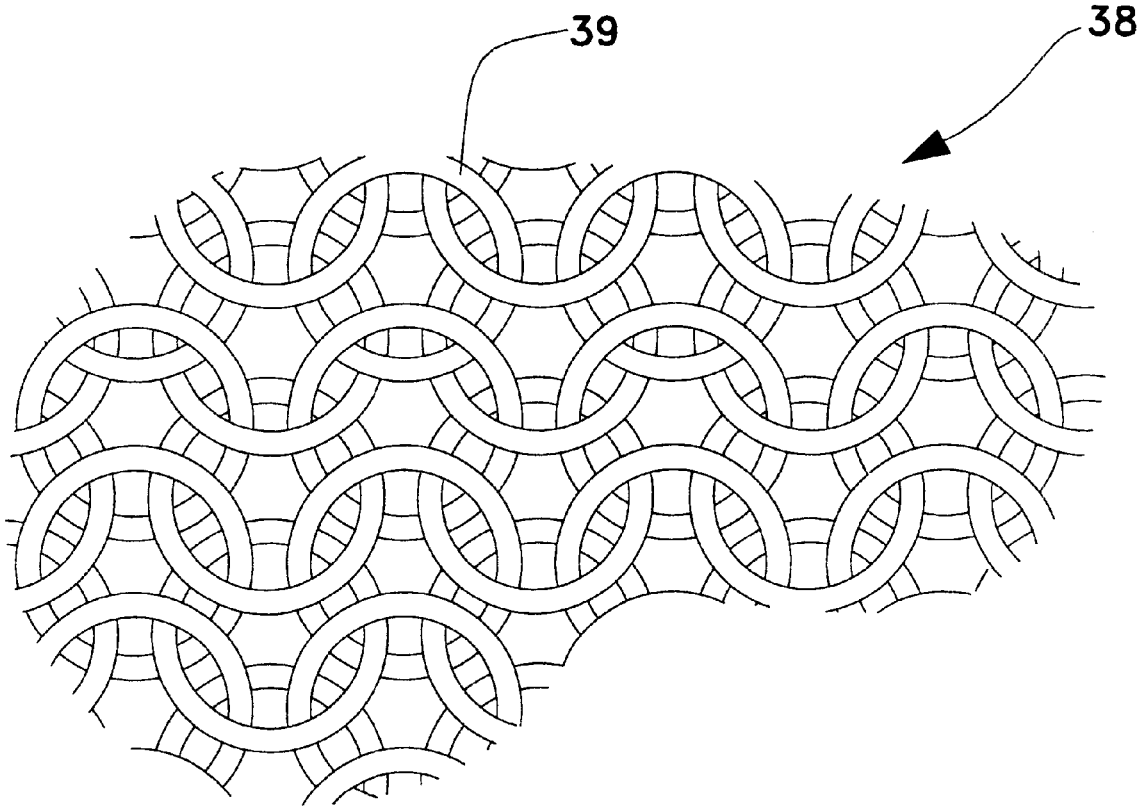
FIG. 2 is a fragmented detail view showing the material from which the body suit is made.

FIG. 2 shows a fragmented detail of a preferred exercise suit 12. The exercise suit 12 is preferably made from chain mail 38, i.e., a plurality of light weight ferromagnetic rings 39 or loops which are linked together, each loop 39 being arranged in rows and joined to about four of its neighbors in the center of the mesh. In a preferred embodiment, the rings 39 are made from a stainless steel alloy which is susceptible to the pull of a magnetic field (martensitic or ferritic, but not austenitic) in order to resist rust or corrosion caused by sweating. The rings 39 may be made from solid metal, or they may be hollow for light applications or novice exercisers. The exercise suit 12 is preferably worn over a light weight undergarment, such as a spandex exercise or jogging outfit.

Figure 6:
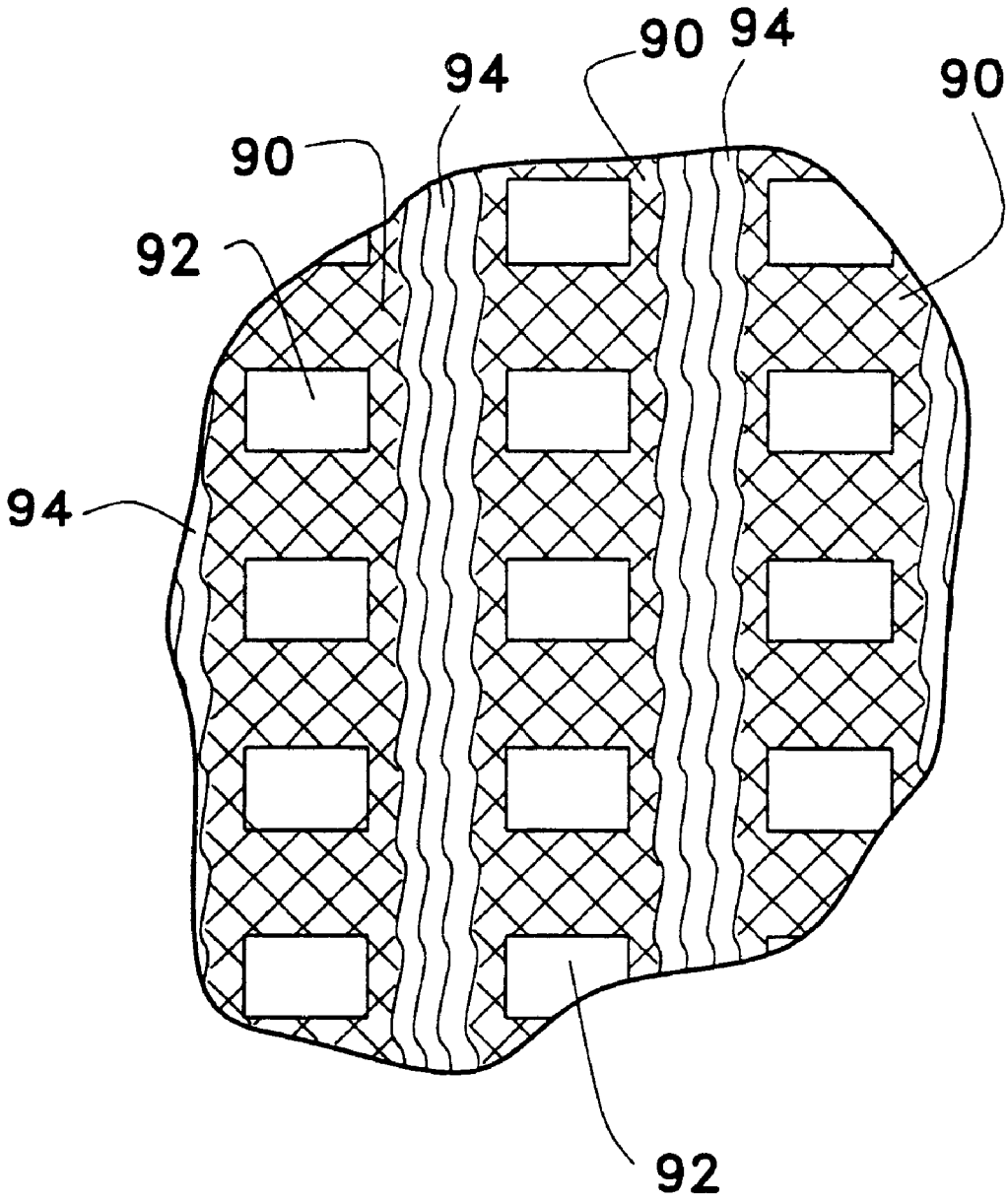
FIG. 6 is a fragmented detail view showing an alternative embodiment of the material from which the body suit is made.

FIG. 6 shows a fragmented detail of an alternative embodiment of the exercise suit 12A. In this embodiment the exercise suit 12A may be made from a lightweight, durable cotton material 90 which may be broadly woven in a pattern similar to undergarments known as "long johns" so that the fabric is or appears to be porous or perforated to allow maximum respiration through the skin and for wicking sweat. Since the material is a flexible fabric, the suit 12A need not have holes 26 in the joints (the inside of the elbows, armpits, back of the knees, etc.), but preferably retains knee pads 33 and elbow pads 24 for cushioning. The cotton suit has a plurality of magnets 92 fixedly attached thereto, as by sewing, with the polarity of the magnets 92 oriented so that each magnet 92 has a pole facing downward when the exerciser A is in a standing position which is opposite in polarity to the pole of the electromagnet below the platform 40. It is understood that the arrangement of magnets 92 in the suit 12A to provide a similar distribution of gravitational force: the upper part of the suit 12A needs to have surplus of magnets to compensate for the relatively weak electromagnetic field comparing to the field closer to the platform 40. Each magnet 92 may be either a ceramic magnet, or a neodymium magnet (a magnet formed from an alloy of neodymium, iron and boron). It is preferred that the magnets 92 have a strength of about 1 Tesla (10,000 gauss). Due to the weight of the magnets 92 and the magnetic force exerted by the platform 40 on the magnets 92, the cotton material is fortified or reinforced at intervals by ribs or strips 94 of reinforcing fabric or other material conventionally used in the clothing industry for reinforcing cotton fabric.

In a first embodiment of the invention, intended primarily for commercial, institutional, or governmental applications, the platform 40 is built into the floor of a gymnasium or other building or structure. The platform 40 consists of a plate 42 made from a ferromagnetic material which is covered by a tenuous or thin sheet 44 or pad of rubber. The plate 42 is disposed within the magnetic field of at least one electromagnet 46, depicted schematically in the block diagram of FIG. 3. The electromagnet 46 may be in the form of a coil 70 of wire (shown in FIG. 4) wound on a spool 72, the spool 72 being a cylindrical soft iron core 74 or bar disposed between a pair of metal plates 42 and 76, the plate 42 being disposed at one end of the iron core 74, the spool 72 being disposed in a sub-floor compartment. Alternatively, the electromagnet 46 may be a plurality of electromagnets built into the plate 42 itself. In a preferred embodiment, the electromagnet 46 may be of the type used in cranes in junkyards for lifting and moving metal objects. However, for purposes of the present invention, it will be understood that the particular physical form of the electromagnet 46 is not critical, provided that the electromagnet 46 exerts a downward magnetic pull and distributes a magnetic field via the platform 40 which attracts the ferromagnetic exercise suit 12 when the exerciser A stands on the platform 40. Preferably the electromagnet 46 is encased in magnetic shielding 78 on all sides except the platform 40 side so that the magnetic field is directly vertically upward from the platform 40 only. The electromagnet 46 may also include a temperature relay switch, cooling fans, or ventilation holes in the magnetic shielding 78 to prevent overheating of the electromagnet 46.

Figure 3:
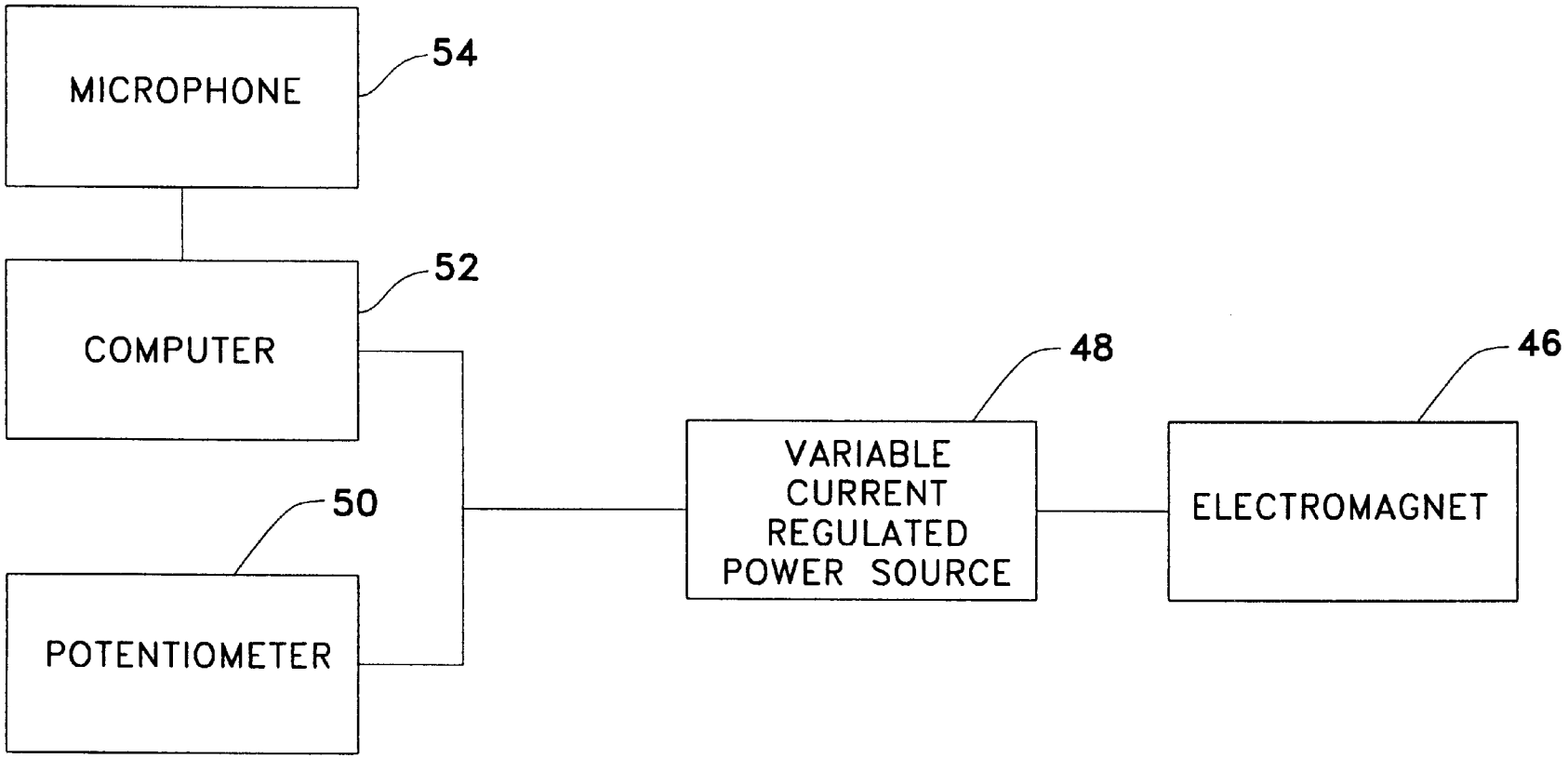
FIG. 3 is a block diagram showing the control system of an exercise apparatus using magnetism to augment the earth's gravitational field according to the present invention.

As shown in FIG. 3, the coil of the electromagnet 46 is provided with current from a variable current regulated power source 48. The power source 48 supplies direct current so that the polarity of the electromagnet does not reverse. Direct current power supplies in which the amount of current supplied may be regulated are well known in the art. Such regulated power sources 48 may include rectifiers for converting alternating current to direct current and step-up transformers and other devices for varying the current in response to either an adjustment control in a solid state power controller 50 or a computer 52 software program interfacing with the power source 48 via an RS-232 serial interface. Preferably when the exercise apparatus 10 of the present invention is operated under computer control, the computer 52 includes a microphone 54 and software to respond to voice commands.

Figure 4:
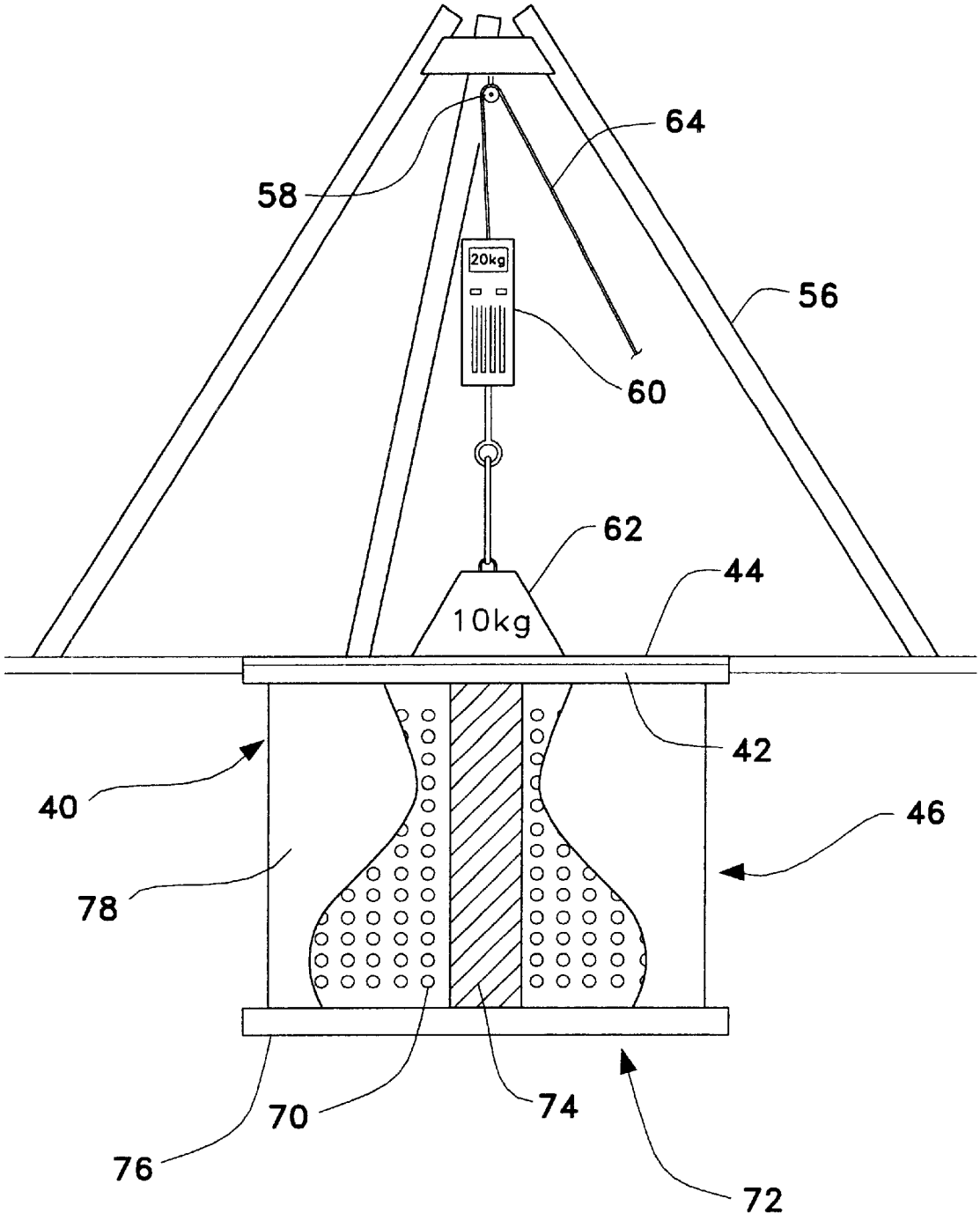
FIG. 4 is a front view of a device for calibrating the exercise apparatus according to the present invention.

In use, since the magnetic field generated by the electromagnet 46 can vary depending upon the particular materials used and the details of construction, the electromagnet 46 should be calibrated to define the strength of the magnetic field developed as a function of the current supplied to the coil. FIG. 4 shows a device for calibrating the exercise apparatus 10. The calibration device includes a tripod 56 mounted over the platform 40. A pulley 58 is attached to the tripod 56. A digital scale 60 and a weight 62 of known mass are suspended from a rope 64 looped around the pulley 58.

The heart of the present invention is the special magnetic suit. It is constructed of reinforced fabric, able to withstand the intense attraction of the magnets and the platform. The fabric is a breathable type that allows proper ventilation during exercise. Either ferromagnetic discs (or bars) or industrial-strength magnets such as neodymium (NdFeB) are embedded in the suit. This embodiment also has inner interlaced fabrics to hold the discs in place (see FIG. 6). The present invention may consist of more than one electromagnet, but it must use direct current (DC). The apparatus may use household current (AC) that must be rectified. For heavy applications, current amplifiers may be used. Methods for regulating current are well known in the arts. The magnitude of the electromagnetic field (EMF) is directly proportional to the current running though the electromagnet or electromagnets. Hence, the magnitude of the force exerted by the present invention is F=Ig/k (Equation 1) where I is the current running through the electromagnet or electromagnets in amperes, g is the acceleration due to Earth's gravity of 9.8 $m/s^2$ and k is the experimental electromagnetic constant (EEC). The constant is defined as the amount of current (in amperes) required to exert a force of 9.8 Newtons on a block of ferromagnetic metal. Its units are Amperes/kilogram. The value of the constant k may differ between various designs and materials used for the electromagnet. Therefore, the value of k should be experimentally determined. To experimentally determine the value of k, a person wearing the special magnetic suit is hung on a digital spring scale over the particular electromagnetic platform, turn the apparatus on at a moderate intensity level, and lower the person until his feet are parallel to the platform and barely touch it. Increase the current if necessary to obtain an accurate reading. The EEC is determined by the formula:

$$k=I/(M_{scale}-(m_u+M_s)) \quad (4)$$

where I is the current in amperes, $M_{scale}$ is the scale reading in kilograms, $m_u$ is the mass of the user in kilograms and $m_s$ is the mass of the suit in kilograms. On Earth, the ratio of the net force to body weight is determined by the formula:

$$?=[(I+m_sk)/m_uk]+1 \quad (5)$$

where I is the current in amperes, $m_u$ is the mass of the user and $m_s$ is the mass of the suit, both in kilograms, and k is the EEC having units of amperes/kilogram. In microgravity environment, the EEC is calculated by the formula:

$$k=I/M_{scale} \quad (6)$$

where I is the current in amperes, $M_{scale}$ is the scale reading in kilograms, and k is the EEC in amperes/kilogram. The ratio of body weight in space is calculated according to the formula:

$$?=I/m_uk \quad (7)$$

where I is the current in amperes, $m_u$ is the mass of the user in kilograms, and k is the EEC in amperes/kilogram. A typical electromagnet has a constant k=0.05 amperes/kilogram, requires only 11.5 amperes to simulate two body weights of a 115 kg man. It is much more efficient than a centrifuge.

In use, the user may set the desired force either by entering the desired force ratio into the computer 52 so that software determines the required current and sends an appropriate control signal to the regulated power source 48, or by rotating the shaft of a calibrated control on a solid state power controller 50.

Figure 5:
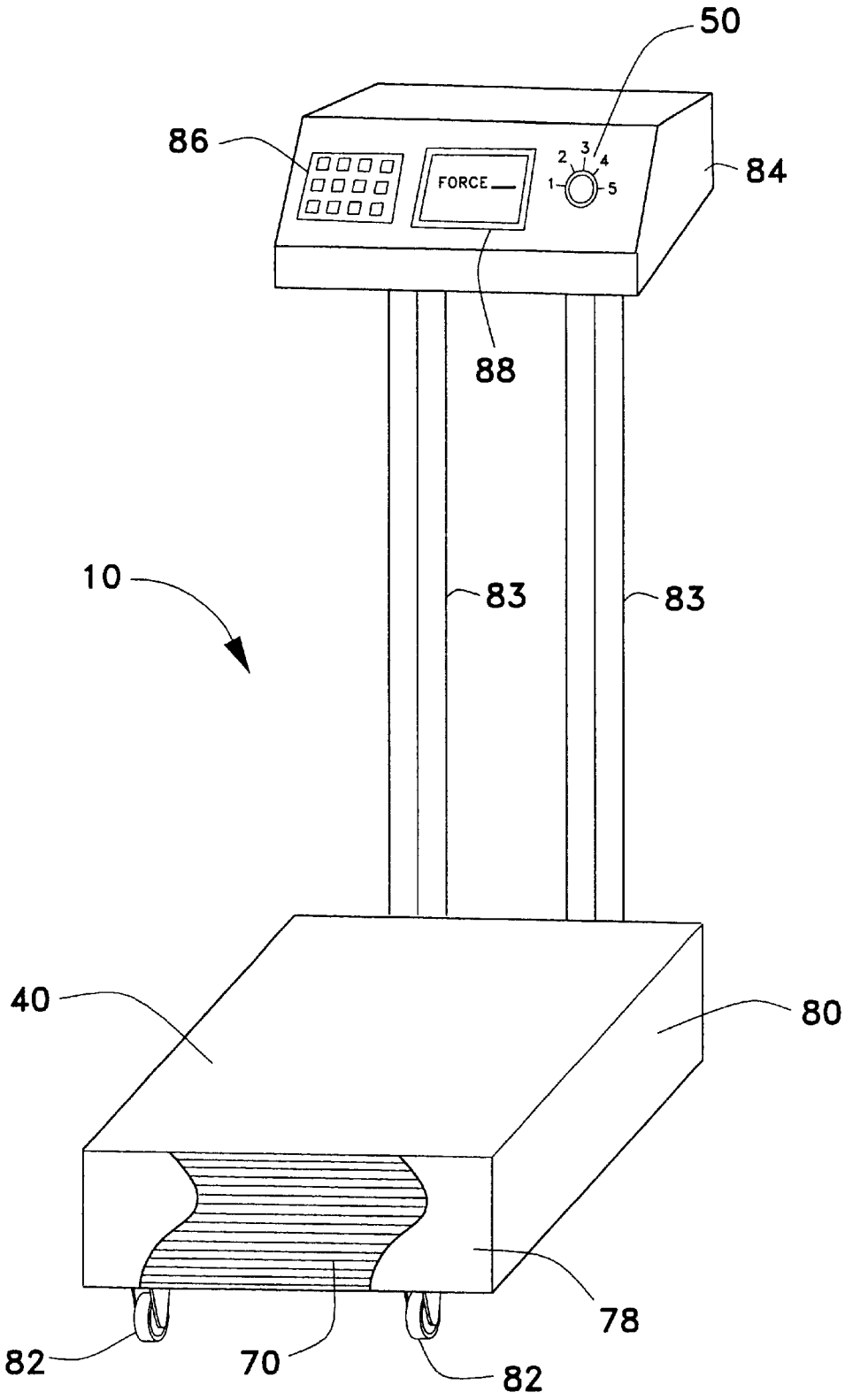
FIG. 5 is a perspective view of an alternate embodiment of an exercise apparatus according to the present invention, partially broken away.

FIG. 5 shows an alternative embodiment of the exercise apparatus 10 which is portable, and therefore better adapted for use in the home. In this embodiment the electromagnet 46 is magnetically shielded in a case 80 which also serves as the base of a cart which is mounted on casters 82 for mobility. The casters 82 are preferably lockable casters so that the exercise device 10 may be locked in a stationary position while in use. The magnetic shielding 78 extends beneath the bottom and around the sides of the coil 70, but does not encase the platform 40. A pair of uprights 83 extend from the case 80 and support a console 84 which may house the computer 52 and solid state power controller 50, as well as electrical circuitry associated with the variable current regulated power source 48. The console 84 may include a computer keypad 86 and liquid crystal display (LCD) 88 to facilitate entry of the desired force ratio into the computer 52. The console 84 may also include a calibrated dial or control for adjusting the solid state power controller 50 for continuous variation of the current supplied to the electromagnet 46.

In use, the exerciser A enters his mass and the mass of the exercise suit 12 into the computer 52 and dons the exercise suit 12. The exerciser A stands on the platform 40 and the exerciser A or a trainer or exercise monitor may enter the desired force ratio ? (which must be greater than one) into the computer 52 and the software automatically computes the desired current I and adjusts the regulated power source 48 accordingly to produce the desired magnetic field. Alternatively, the power controller 50 may be adjusted to provide the desired magnetic field. The force of the magnetic field adds to the force of the gravitational field so that the exerciser A experiences increased resistance while performing knee bends, squats, leg lifts, or other exercises on the platform 40 with or without the aid of external devices, such as parallel bars B, rings, or other gymnastic equipment. The computer 52 may be equipped with a microphone 54 and voice recognition software so that the exerciser A may issue a voice command for emergency shutdown when the intensity or force exerted by the apparatus 10 exceeds his or her capacity. The tenuous rubber pad 44 also serves as a measure of insulation for safety purposes. The bio-magnetic effects of exercise within a magnetic field enhances the therapeutic value of exercise with the exercise apparatus 10 of the present invention.

Figure 7:
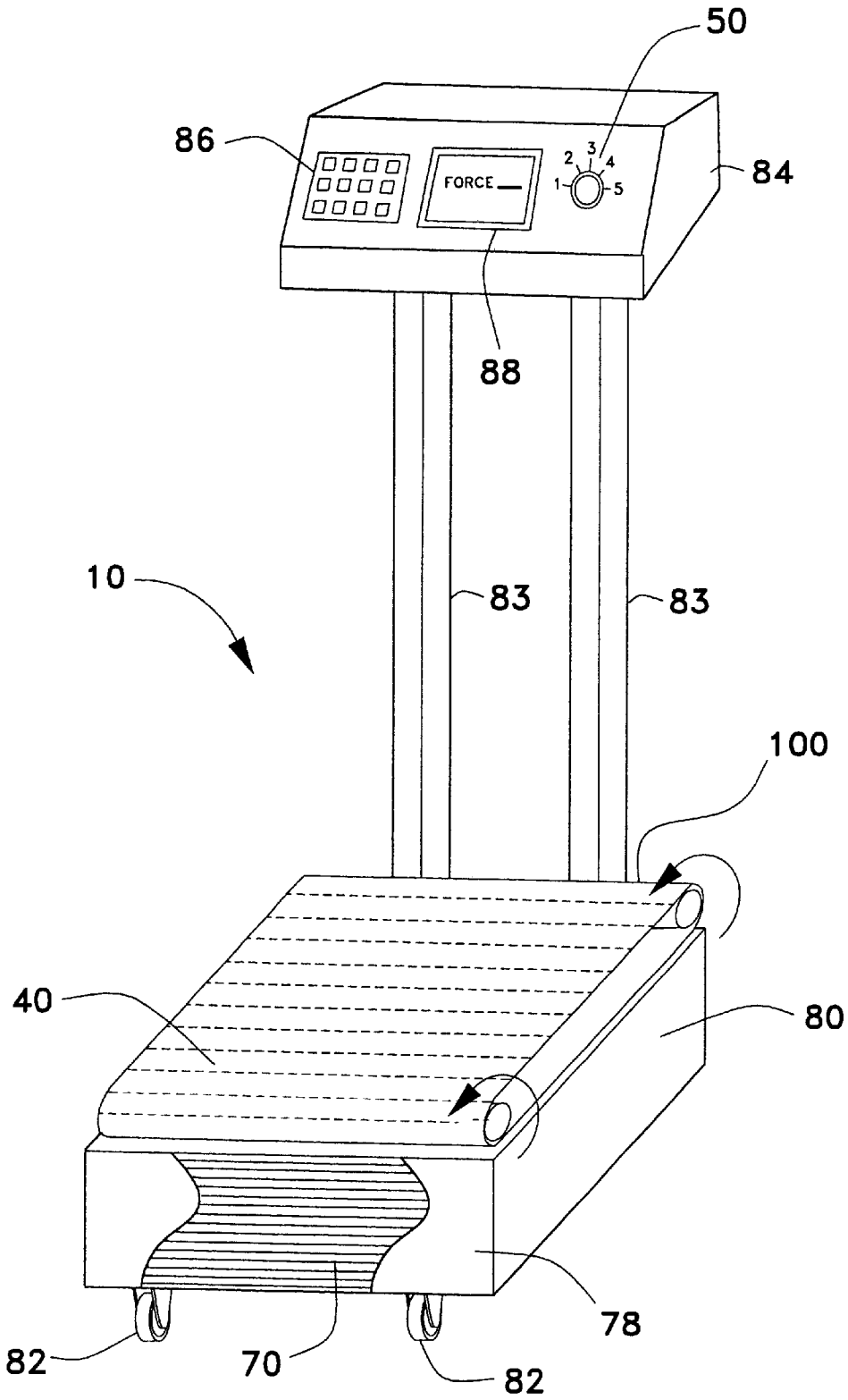
FIG. 7 is a perspective view similar to that of FIG. 5, showing the placement of a treadmill on the exercise device.

Referring to FIG. 7 there is shown another embodiment, as explained in part above similar to that of FIG. 5 where a treadmill 100 is combined with the inventive exercise apparatus 10.

Figure 8:
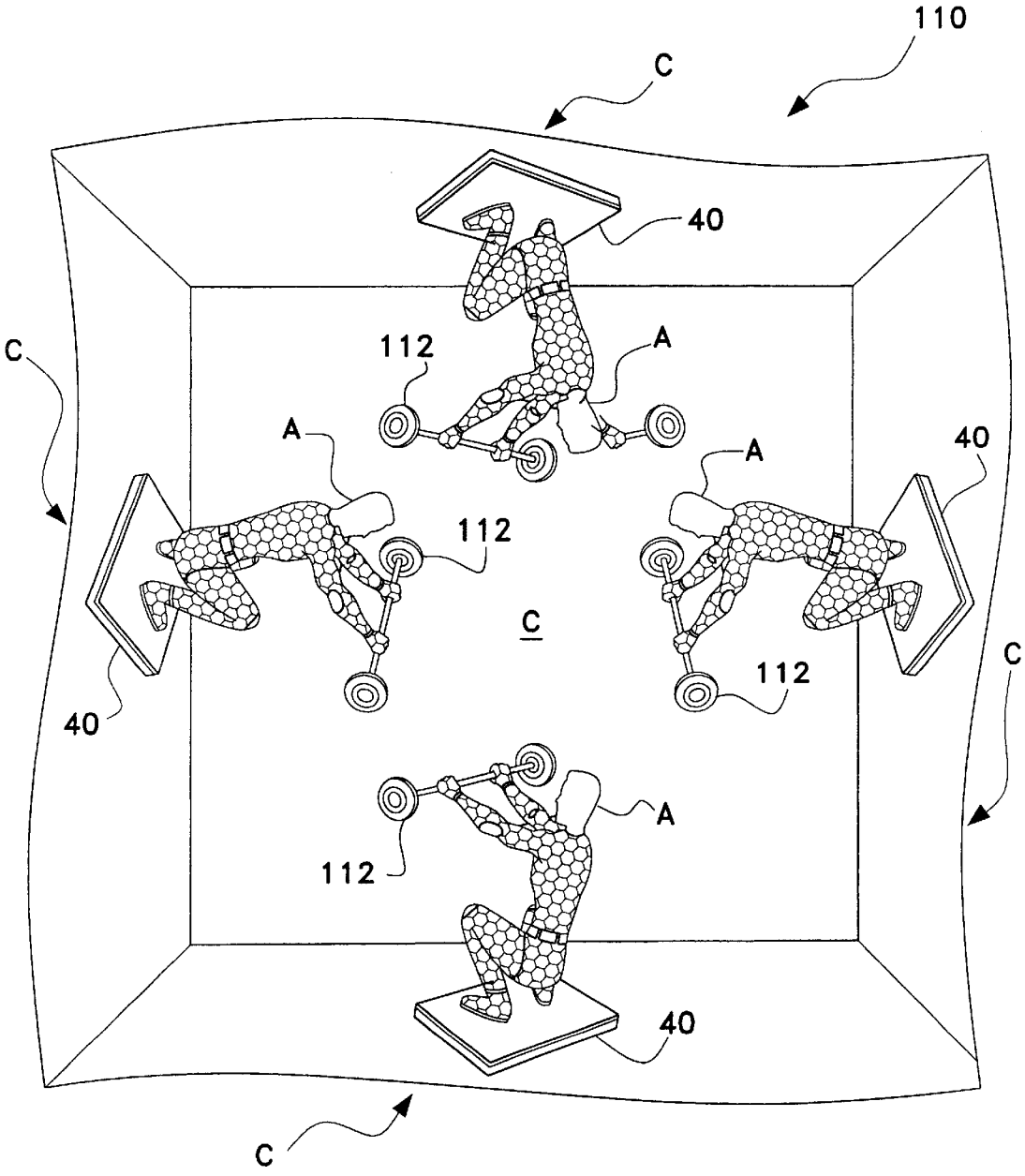
FIG. 8 is an environmental view of space travelers using another embodiment of the invention for space craft use in an exercise cubicle.

Referring to FIG. 8 there is shown another embodiment, as explained in part above for use in spacecraft and other zero gravity environments wherein an exercise cubical 110, formed by shielding walls C may accommodate a group of space travelers A using the apparatus 10 of FIG. 1 or similar apparatus as described above and barbells 112.

The present invention may be either a stationary installation or installed in treadmills. Space station Mir crew members have exercised for two to three hours per day at approximately 50% body weight. My apparatus allows comfortable loading of force at one or more body weights. Thus, the exercise time required for astronauts and Earth-bound people to maintain or gain musculoskeletal strength can be substantially reduced by high levels of exercise loads. Astronauts or people on Earth may perform many exercises such as pushups, sit-ups, squats, jogging, etc. to gain optimum health.

The present invention is shielded to prevent interference with electronic equipment. Its EMF is contained by electromagnetic field absorbing material such as steel. A room specialized for training may be installed on the International Space Station with all sides of the room shielded to prevent interference with complex space station electronics and experiments. A large electromagnetic platform may be installed into the floor to provide maximum space for training. The room would increase efficiency by allowing multiple users with minimal power consumption. It is believed that exercise in such an environment would simulate physiologic and bio-mechanical features of upright exercise on Earth. The magnitude and mechanism of force produced by the present invention have important implications for simulating hyper gravity in Space and on Earth without the use of centrifuge or air pressure systems.

It is to be understood that the present invention is not limited to the sole embodiments described above, but encompasses any and all embodiments within the scope of the following claims.

I claim:

1. An exercise apparatus using magnetism to augment a gravitational field, comprising:

a) a full body exercise suit made from a ferromagnetic material for covering an exerciser's body from the neck to the feet;

b) a platform, including a plate made from a ferromagnetic material; and c) at least one electromagnet disposed to apply a magnetic field through said platform to attract said exercise suit and augment a force exerted by the gravitational field when an exerciser stands on said platform.

2. The exercise apparatus using magnetism to augment a gravitational field according to claim 1, wherein said exercise suit is made from chain mail.

3. The exercise apparatus using magnetism to augment a gravitational field according to claim 1, wherein said exercise suit further comprises:

a) a vest portion including a covering for the torso and arms;

b) a pair of gloves releasably fastened to the arms of the vest portion;

c) a pant portion including a belt and a pair of legs, the pant portion being releasably fastened to said vest portion; and d) a pair of feet, the feet being releasably fastened to the legs of said pant portion and having a chain mail covering for the dorsal surface of an exerciser's feet.

4. The exercise apparatus using magnetism to augment a gravitational field according to claim 1, wherein said platform further comprises a tenuous rubber pad covering a surface of said plate.

5. The exercise apparatus using magnetism to augment a gravitational field according to claim 1, wherein said at least one electromagnet comprises:

a) a spool having a cylindrical core of soft iron having a first end and a second end and having a first plate and a second plate transverse to the core at the first and second ends, respectively, one of the plates defining the plate of said platform; and b) a coil of wire wrapped around said soft iron core.

6. The exercise apparatus using magnetism to augment a gravitational field according to claim 1, further comprising magnetic shielding enclosing a portion of said electromagnet, provided that the shielding permits the magnetic field to be directed through said platform.

7. The exercise apparatus using magnetism to augment a gravitational field according to claim 1, further comprising a variable current regulated power source electrically connected to said at least one electromagnet.

8. The exercise apparatus using magnetism to augment a gravitational field according to claim 7, further comprising a potentiometer electrically connected to said variable current regulated power source for varying the current supplied to said at least one electromagnet in order to vary the strength of the magnetic field.

9. The exercise apparatus using magnetism to augment a gravitational field according to claim 7, further comprising a computer electrically connected to said variable current regulated power source for varying the current supplied to said at least one electromagnet in order to vary the strength of the magnetic field, said computer having software operating thereon permitting an exerciser to enter a desired magnetic field strength.

10. The exercise apparatus using magnetism to augment a gravitational field according to claim 9, further comprising a microphone connected to said computer, said computer operating voice activated software for performing emergency shutdown of said exercise apparatus.

11. The exercise apparatus using magnetism to augment a gravitational field according to claim 1, wherein said platform is installable in the floor of a permanent structure.

12. The exercise apparatus using magnetism to augment a gravitational field according to claim 1, further comprising:

a) magnetic shielding defining a case enclosing a portion of said at least one electromagnet;

b) a plurality of casters attached to said case, defining a cart mounting said at least one electromagnet and said platform, whereby the exercise apparatus is portable.

13. An exercise apparatus using magnetism to augment a gravitational field, comprising:

a) a full body exercise suit incorporating a magnetic material for covering an exerciser's body from the neck to the feet;

b) a platform including a plate made from a ferromagnetic material; and c) at least one electromagnet disposed to apply a magnetic field through said platform to attract said exercise suit and augment a force exerted by the gravitational field when an exerciser stands on said platform.

14. The exercise apparatus according to claim 13, wherein said exercise suit is made from cotton fabric and has a plurality of magnets fixedly attached to said cotton fabric.

15. The exercise apparatus according to claim 13, in combination with a treadmill.

16. The exercise apparatus according to claim 13, wherein said apparatus is sufficiently shielded to render it useful on spacecraft in a micro-gravity environment.

17. The exercise apparatus according to claim 16, wherein said shielding forms a room suitable for a plurality of astronauts to exercise simultaneously.

18. A method of exercising comprising:

providing a body suit having magnetic material incorporated therein;

providing a variable power electromagnet having a control and a platform of covering magnetic material covering;

adjusting said control to attain a desired multiple of gravity; and performing standard exercises on said platform.

19. The method of exercising according to claim 18 wherein a treadmill is provided on said platform.

20. The method of exercising according to claim 19 wherein said exercise is conducted under micro-gravity conditions.

* * * * *